US006053991A

United States Patent [19]

Yokoi et al.

[11] Patent Number: 6,053,991

[45] Date of Patent: Apr. 25, 2000

[54] PRODUCTION OF COLD WORKING TOOL STEEL

[75] Inventors: Daien Yokoi; Nobuhiro Tsujii, both of Himeji, Japan

[73] Assignee: Sanyo Special Steel Co., Ltd., Himeji, Japan

[21] Appl. No.: 09/086,487

[22] Filed: May 29, 1998

[30] Foreign Application Priority Data

Jan. 6, 1998 [JP] Japan ..... 10-000607
Feb. 2, 1998 [JP] Japan ..... 10-021302

[51] Int. Cl.[7] ..... C21D 6/02; C22C 38/22; C22C 38/24

[52] U.S. Cl. ..... 148/326; 148/325; 148/334; 148/579; 148/605

[58] Field of Search ..... 420/69, 101, 110, 420/111; 148/326, 325, 334, 579, 605

[56] References Cited

FOREIGN PATENT DOCUMENTS

| | | |
|---|---|---|
| 56-075554 | 6/1981 | Japan . |
| 59-704263 | 4/1984 | Japan . |
| 1-201442 | 8/1989 | Japan . |
| 201442 | 8/1989 | Japan . |
| 2-247357 | 10/1990 | Japan . |
| 2-277745 | 11/1990 | Japan . |
| 3-134136 | 6/1991 | Japan . |
| 156407 | 6/1993 | Japan . |
| 5-156407 | 6/1993 | Japan . |
| 212253 | 8/1994 | Japan . |
| 6-212253 | 8/1994 | Japan . |
| 6-340945 | 12/1994 | Japan . |
| 8-120333 | 5/1996 | Japan . |

*Primary Examiner*—Deborah Yee
*Attorney, Agent, or Firm*—Birch, Stewart, Kolasch & Birch, LLP

[57] ABSTRACT

Disclosed are a cold working tool steel suitable for plastic cold working tools used under severe service conditions, such as forming dies, forming rolls, and form rolling dies, and a process for producing the same. The cold working tool steel has wear resistance and tensile compression fatigue strength and at the same time can provide improved die life. The cold working tool steel is characterized by comprising by weight 0.65 to 1.3% of carbon, not more than 2.0% of silicon, 0.1 to 2.0% of manganese, 5.0 to 11.0% of chromium, 0.7 to 5.0%, in terms of molybdenum equivalent (molybdenum+tungsten/2), of at least one member selected from molybdenum and tungsten, 0.1 to 2.5%, in terms of vanadium equivalent (vanadium+niobium/2), of at least one member selected from vanadium and niobium, and optionally 0.010 to 0.10% of sulfur with the balance consisting of iron and unavoidable impurities, an $M_7C_3$ carbide having a grain diameter of 5 to 15 $\mu$m being present in a percentage area of 1 to 9%. The process is characterized by comprising the steps of: providing a steel product having the above chemical composition; and tempering the steel product at a temperature of 150 to 500° C., preferably 150 to below 450° C.

15 Claims, 4 Drawing Sheets

PRODUCTION OF COLD WORKING TOOL STEEL

BACKGROUND OF THE INVENTION

1. Field of the Invention

The present invention relates to the production of a cold working tool steel for a long-life die having improved fatigue strength that is suitable as plastic cold working tools used under severe conditions, such as forming dies, forming rolls, and form rolling dies.

2. Description of the Prior Art

JIS-SKD11, a high carbon-high chromium steel, has hitherto been extensively used for cold working tools from the viewpoint of wear resistance. SKD11 (corresponding to AISI-D2) contains an $M_7C_3$ type primary carbide composed mainly of chromium in a percentage area of 8 to 15%, thereby ensuring the wear resistance.

An advance of plastic working technology and an increase in strength of a material to be worked in recent years have increased a stress load applied to cold working tools used. This has increased situations with which SKD11 cannot cope due to unsatisfactory hardness and toughness. Specifically, for SKD11, which, upon tempering at a high temperature of 500° C., has a hardness of 60 HRC, the wear resistance is still ensured, but the $M_7C_3$ carbide is coarsened, unfavorably resulting in a lowered die life.

For this reason, inventions directed to various steels have been proposed from the viewpoint of improving the function of the material. These inventions are disclosed, for example, in Japanese Patent Laid-Open Nos. 201442/1989, 247357/1990, 277745/1990, 134136/1991, 156407/1993, and 212253/1994.

The invention disclosed in Japanese Patent Laid-Open No. 201442/1989 relates to a steel for a form rolling die, comprising by weight 0.90 to 1.35% of carbon, 0.70 to 1.4% of silicon, not more than 1.0% of manganese, not more than 0.004% of sulfur, 6.0 to 10.0% of chromium, 1.5 to 2.5%, in terms of molybdenum+tungsten/2, of at least one member selected from molybdenum and tungsten, and 0.15 to 2.5%, in terms of vanadium+niobium/2, of at least one member selected from vanadium and niobium with the balance consisting of iron, an $M_7C_3$ carbide being present, in a quenched/tempered structure, in a percentage area of 2 to 9% with an MC carbide being present in a percentage area of not more than 2.5%. According to this invention, the percentage area and grain diameter of carbides are regulated with a view to improving mainly the toughness and preventing the propagation of cracks through a route of carbides distributed in a chain form.

The invention disclosed in Japanese Patent Laid-Open No. 247357/1990 relates to a steel for a form rolling die, comprising the constituents of the steel disclosed in Japanese Patent Laid-Open No. 201442/1989 and, in addition, not more than 0.13% in total of arsenic, tin, antimony, copper, lead, and bismuth. The invention disclosed in Japanese Patent Laid-Open No. 277745/1990 relates to a quenched/tempered structure wherein the percentage area in total of at least one member selected from MC type residual carbides and $M_6C$ type residual carbides having a grain diameter of not less than 2 $\mu$m is regulated to not more than 3% with the percentage area of $M_7C_3$ type residual carbides having a grain diameter of not less than 2 $\mu$m being regulated to not more than 1%. As with the invention disclosed in Japanese Patent Laid-Open No. 201442/1989, these inventions aim mainly to improve the toughness and to prevent the propagation of cracks through a route of carbides distributed in a chain form.

The invention disclosed in Japanese Patent Laid-Open No. 134136/1991 relates to a high-hardness, high-toughness cold working tool, comprising the constituents of the steel according to the invention disclosed in Japanese Patent Laid-Open No. 201442/1989 and, in addition, not more than 0.02% of phosphorus, not more than 0.005% of sulfur, not more than 30 ppm of oxygen, and not more than 300 ppm of nitrogen, wherein, in the quenched/tempered structure, the percentage area of $M_7C_3$ type residual carbides having a grain diameter of not less than 2 $\mu$m is not more than 8% and the percentage area in total of at least one member selected from MC type residual carbides and $M_6C$ type residual carbides having a grain diameter of not less than 2 $\mu$m is not more than 3%. The invention disclosed in Japanese Patent Laid-Open No. 156407/1993 relates to a steel for a high performance form rolling die wherein, upon quenching/tempering, a microstructure is developed with $M_7C_3$ type primary carbides in a percentage area of not more than 4.0% and MC type primary carbides in a percentage area of not more than 0.5% being homogeneously dispersed in a matrix with the maximum grain diameter of the primary carbides being substantially not more than 20 $\mu$m, and, when the steel is quenched from a temperature of from 1050–1100° C. to 500° C. at a cooling rate of 25° C./min and then tempered at a high temperature, the hardness can be brought to not less than HRC 64. All of these inventions aim mainly to improve the toughness and to prevent the propagation of cracks through a route of carbides distributed in a chain form.

The invention disclosed in Japanese Patent Laid-Open No. 212253/1994 relates to a process for producing a cold working tool steel, characterized in that a steel product comprising by weight 0.75 to 1.75% of carbon, 0.5 to 3.0% of silicon, 0.1 to 2.0% of manganese, 5.0 to 11.0% of chromium, 1.3 to 5.0% of molybdenum, and 0.1 to 5.0% of vanadium, with the balance consisting of iron is tempered at a temperature of 450° C. or above. This invention aims mainly to improve the toughness and to prevent the propagation of cracks through a route of carbides distributed in a chain form. Tempering at a high temperature of 450° C. or above increases the secondary hardening hardness to markedly improve the service life and electrical discharge machinability of the cold working tool steel.

In all the above-described prior art techniques, the size of the carbide is regulated from the viewpoint of improving the toughness or the strength. That is, the above-described prior art techniques aim to prevent the accumulation of microdefects created by lack of primary carbides and to prevent the propagation of cracks through a route of large primary carbides distributed in a chain form.

An advance of plastic working technology and an increase in strength of a material to be worked in recent years have led to a strong demand for the development of a tool steel for a die having better wear resistance and fatigue resistance.

SUMMARY OF THE INVENTION

An object of the present invention is to provide a cold working tool steel which has wear resistance and tensile compression fatigue strength and can ensure excellent die life, and a process for producing the same.

The present inventors have found that a variation in die life and extremely short die life are attributable mainly to the occurrence of cracks due to cracking of $M_7C_3$ type carbides and the propagation of cracks and these can be prevented by regulating the grain diameter and percentage area of $M_7C_3$ type carbides. They have further found that tempering of a tool, used under severe environment where high stress is applied, at a low temperature of 150 to 500° C. leads to the formation of retained austenite in a larger amount than the amount of retained austenite formed upon high temperature tempering, permitting the concentration of stress on the carbides to be relaxed by the retained austenite, which can prevent cracking of the carbides.

One aspect of the present invention provides (1) a cold working tool steel having improved fatigue strength and die life, characterized by comprising by weight 0.65 to 1.3% of carbon, not more than 2.0% of silicon, 0.1 to 2.0% of manganese, 5.0 to 11.0% of chromium, 0.7 to 5.0%, in terms of molybdenum equivalent (molybdenum+tungsten/2), of at least one member selected from molybdenum and tungsten, and 0.1 to 2.5%, in terms of vanadium equivalent (vanadium+niobium/2), of at least one member selected from vanadium and niobium with the balance consisting of iron and unavoidable impurities, an $M_7C_3$ carbide having a grain diameter of 5 to 15 $\mu$m being present in a percentage area of 1 to 9%, and (2) the cold working tool steel according to the above item (1), wherein 0.01 to 0.10% by weight of sulfur has been substituted for a part of the iron as the balance.

According to another aspect of the present invention, there is provided a process for producing a cold working tool steel having improved fatigue strength and die life, characterized in that a steel product having the above composition with $M_7C_3$ carbides having the above grain diameter being present in the above percentage area is tempered at 150 to 500° C., preferably 150 to below 450° C.

According to the present invention, the regulation of the grain diameter and percentage area of the $M_7C_3$ carbides in a certain range and tempering at a specific temperature can prevent the occurrence of cracks derived from cracking of the carbides and the propagation of the cracks. This can reduce the variation in die life and the dies having an extremely short service life. Therefore, excellent die life can be ensured, rendering the steel very advantageously cost-effective as a tool steel for a die over the conventional tool steel for a die.

PREFERRED EMBODIMENTS OF THE INVENTION

Figure 1:
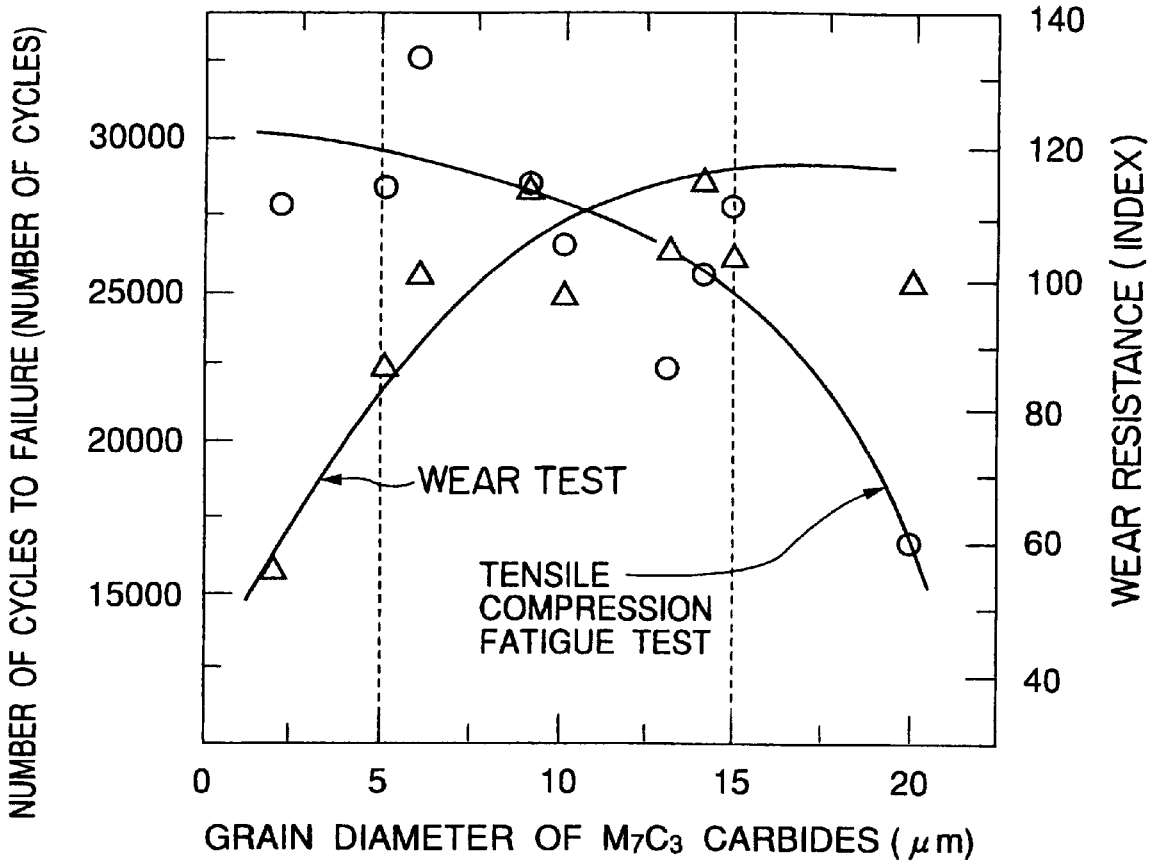
FIG. 1 is a diagram showing the relationship between the grain diameter of $M_7C_3$ carbides and the number of cycles to failure and the wear resistance.

The function of the chemical composition of the cold working tool steel according to the present invention and the reasons for the limitation of the chemical composition will be described.

Carbon is an element that provides satisfactory matrix hardness upon quenching/tempering and combines with chromium, molybdenum, vanadium, niobium and the like to form carbides, thereby imparting high temperature strength and wear resistance to the steel. Addition of carbon in an excessive amount results in precipitation of excessive coarse carbides at the time of solidification, adversely affecting the toughness. For this reason, the upper limit of the carbon content should be 1.3%. On the other hand, when the carbon content is less than 0.65%, the secondary hardening hardness is unsatisfactory. Therefore, the lower limit of the carbon content should be 0.65%. The carbon content is more preferably in the range of 0.75 to 1.1% from the viewpoint of offering the optimal balance between the strength and the toughness.

Silicon is an element that is added mainly as a deoxidizer and is effective in imparting oxidation resistance and hardenability. Further, silicon prevents aggregation of carbides in the course of tempering to accelerate secondary hardening. Addition of silicon in an amount exceeding 2.0%, however, lowers the toughness. For this reason, the upper limit of the silicon content should be 2.0%.

Manganese is an element that, as with silicon, is added as a deoxidizer and enhances the cleanness and hardenability of the steel. Addition of manganese in an amount exceeding 2.0% inhibits the cold workability and at the same time deteriorates the toughness. For this reason, the upper limit of the manganese content should be 2.0%.

Chromium is an element that is effective in enhancing the hardenability and, in addition, enhancing the resistance to temper softening. In order to attain this effect, the chromium content should be at least 5.0%. For this reason, the lower limit of the chromium content should be 5.0%. On the other hand, chromium is likely to combine with carbon at the time of solidification to form a giant primary carbide, and the addition of chromium in an excessive amount deteriorates the toughness. Therefore, the upper limit of the chromium content should be 11.0%.

Molybdenum and tungsten are both important elements that form a fine carbide, contribute to secondary hardening, and at the same time improve the resistance to softening. In this case, the degree of the effect attained by molybdenum is twice better than that attained by tungsten. Therefore, the amount of tungsten necessary for attaining the same degree of effect as molybdenum is twice larger than that of molybdenum. The effect of both the elements can be expressed in terms of molybdenum equivalent (molybdenum+tungsten/2), and the amount of molybdenum and tungsten added should be not less than 0.7% in terms of the molybdenum equivalent. The addition of molybdenum and tungsten in an excessive amount in terms of the molybdenum equivalent, however, leads to lowered toughness. Therefore, the upper limit of the molybdenum equivalent should be 5.0%.

Vanadium and niobium are both useful for secondary hardening, combine with carbon to form a hard carbide, greatly contributing to an improvement in wear resistance, and in addition refines grains. In this case, the degree of the effect attained by vanadium is twice better than that attained by niobium. Therefore, the amount of niobium necessary for attaining the same degree of effect as vanadium is twice larger than that of vanadium. The effect of both the elements can be expressed in terms of vanadium equivalent (vanadium+niobium/2), and the amount of vanadium and niobium added should be at least 0.1% in terms of the vanadium equivalent in order to provide high-temperature temper hardness. The addition of vanadium and niobium in an excessive amount in terms of the vanadium equivalent leads to lowered toughness. Therefore, the upper limit of the vanadium equivalent should be 2.5%.

Sulfur is an element that greatly contributes to an improvement in machinability, and the addition of sulfur in an amount of not less than 0.010% is necessary for attaining this effect. If sulfur is added in an excessive amount exceeding 0.10%, however, the hot ductility would be deteriorated. For this reason, the upper limit of the sulfur content should be 0.1%.

Next, the grain diameter of $M_7C_3$ carbides in the cold working tool steel according to the present invention will be explained.

For eutectic carbides that are crystallized at thus time of solidification of the cold working tool steel, the size of the primary carbide has hitherto been regulated from the viewpoint of toughness and strength. The regulation aims to prevent the accumulation of microdefects created by lack of primary carbides and to prevent the propagation of cracks through a route of primary carbides. As a result of detailed investigations on this matter conducted by the present inventors, it has been found that the service life of tools, such as dies, produced from cold working tool steel is influenced by tensile compression fatigue. The present inventors have further found that breaking of the actual die induced by the fatigue of the die is attributable mainly to the occurrence of cracks of $M_7C_3$ carbides and the propagation of cracks.

FIG. 1 is a diagram showing the relationship between the grain diameter ($\mu$m) of $M_7C_3$ carbides and the number of cycles to failure (number of cycles) and the wear resistance (index). The term "cycles to failure" used herein refers to the number of cycles of a load (tension+compression) applied to a test piece in a tensile compression test until the test piece is broken. The results of a tensile compression fatigue test (○) shown in FIG. 1 demonstrate that, when the grain diameter of $M_7C_3$ carbides exceeds 15 $\mu$m, the number of cycles to failure is significantly reduced. On the other hand, the results of an Ohkoshi type wear test (Δ) show that, when the grain diameter of $M_7C_3$ carbides is less than 5 $\mu$m, the wear resistance is significantly reduced.

From the above results, it was found that the regulation of the grain diameter of $M_7C_3$ carbides to 5 to 15 $\mu$m is optimal for prolonging the die life. More specifically, the grain diameter of $M_7C_3$ carbides is preferably not more than 15 $\mu$m from the viewpoint of the breakage attributable to tensile compression fatigue and not less than 5 $\mu$m from the viewpoint of the wear resistance.

Figure 2:
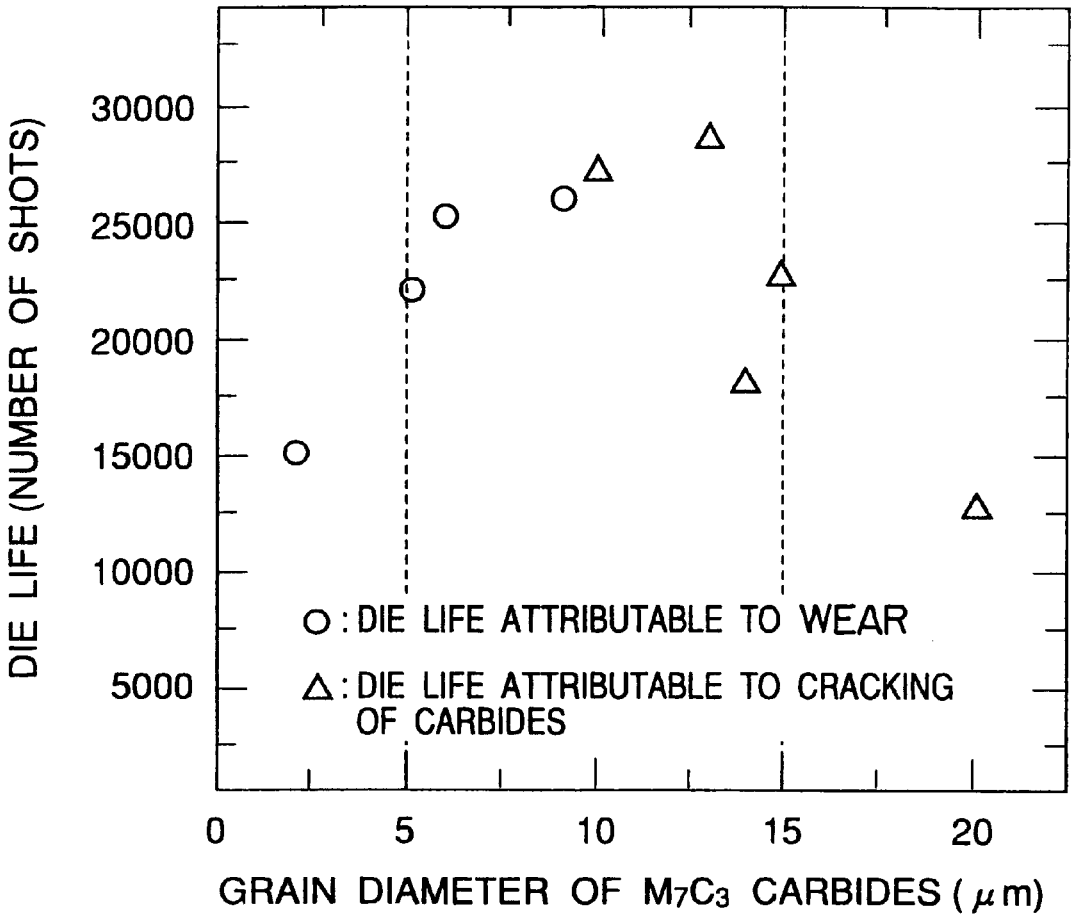
FIG. 2 is a diagram showing the relationship between the grain diameter of $M_7C_3$ carbides and the die life (number of shots) with respect to Example 1 of the present invention.

FIG. 2 is a diagram showing the relationship between the grain diameter ($\mu$m) of $M_7C_3$ carbides and the die life (number of shots). The term "die life" used herein refers to the number of times of use of a die until the die becomes unusable. The die life is expressed in terms of number of shots in forging. The die life expires for two reasons, wearing and cracking of carbides. According to FIG. 2, when the grain diameter of $M_7C_3$ is less than 5 $\mu$m, the number of shots with respect to the die life (○) attributable to the wearing is reduced. On the other hand, when the grain diameter of $M_7C_3$ carbides exceeds 15 $\mu$m, the number of shots with respect to the die life (Δ) attributable to cracking of the carbides is reduced. As with the results shown in FIG. 1, the results shown in FIG. 2 demonstrate that the regulation of the grain diameter of $M_7C_3$ carbides to 5–15 $\mu$m is optimal for prolonging the die life.

Regarding the percentage area of the $M_7C_3$ carbide, the wear resistance improves with increasing the amount of the carbide, and the presence of the $M_7C_3$ carbide in an amount of at least 1% is necessary for the wear resistance. On the other hand, the presence of the carbide in an amount of not more than 9% is preferred for dispersing the carbide as homogeneously as possible from the viewpoint of the fatigue resistance. For this reason, the percentage area of the $M_7C_3$ carbide is limited to 1 to 9%.

The optimal tempering temperature range of the cold working tool steel according to the present invention will be described.

Figure 3:
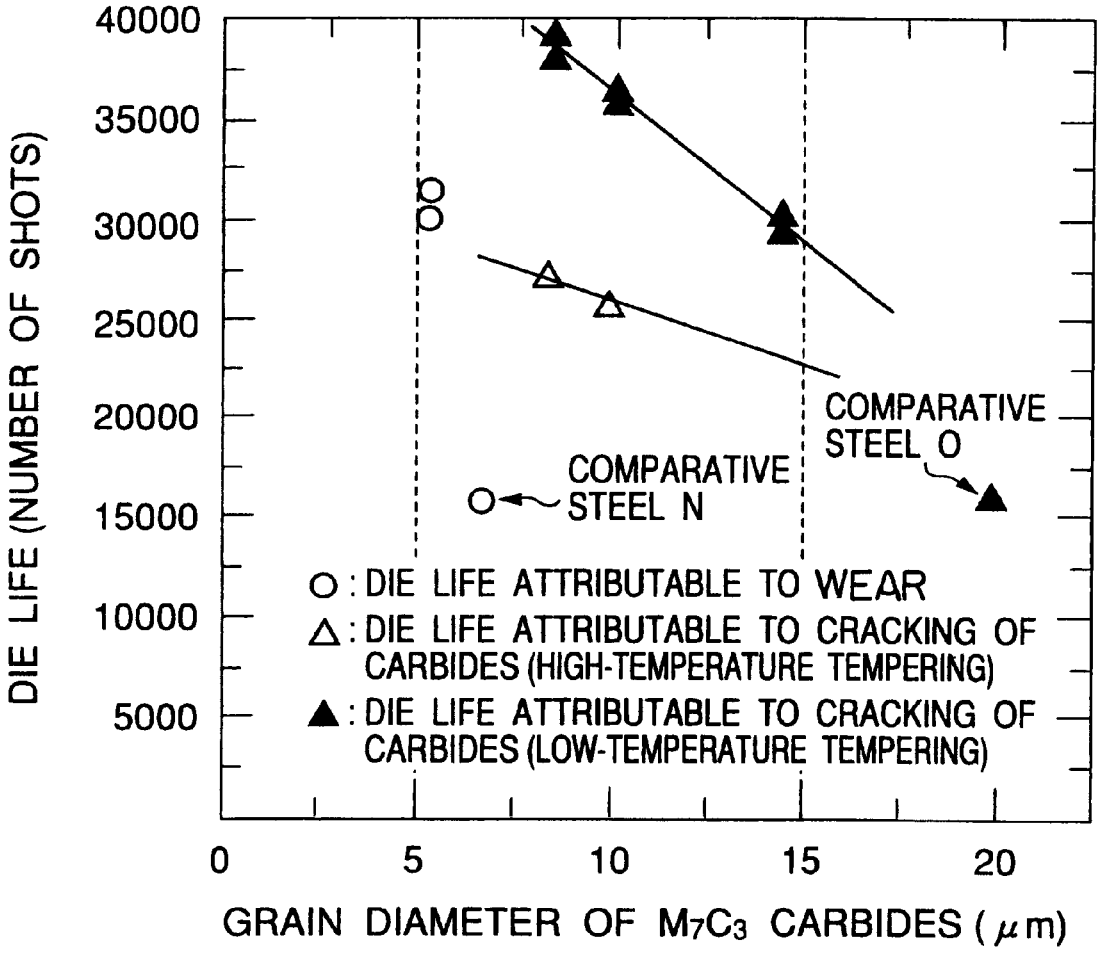
FIG. 3 is a diagram showing the relationship between the grain diameter of $M_7C_3$ carbides and the die life (number of shots) with respect to Example 2 of the present invention.

FIG. 3 is a diagram showing the relationship between the grain diameter of $M_7C_3$ carbides and the die life (number of shots). As is apparent from FIG. 3, the die life for comparative steel N (tempered at a low temperature of 180° C.) described below is a die life (○) attributable to the wearing, while the die life for comparative steel O (tempered at a low temperature of 300° C.) is a die life (▲) attributable to cracking of the carbide. Further, comparison of tempering (▲) at a low temperature of 150 to 500° C. with tempering (Δ) at a high temperature of 500 to 550° C. shows that the die life in the case of tempering at a low temperature is longer than that in the case of tempering at a high temperature. This can be said from the fact that the number of shots with respect to the die life (Δ) attributable to the cracking of carbide of the material tempered at a high temperature is smaller than that in the case of tempering at a low temperature.

Figure 4:
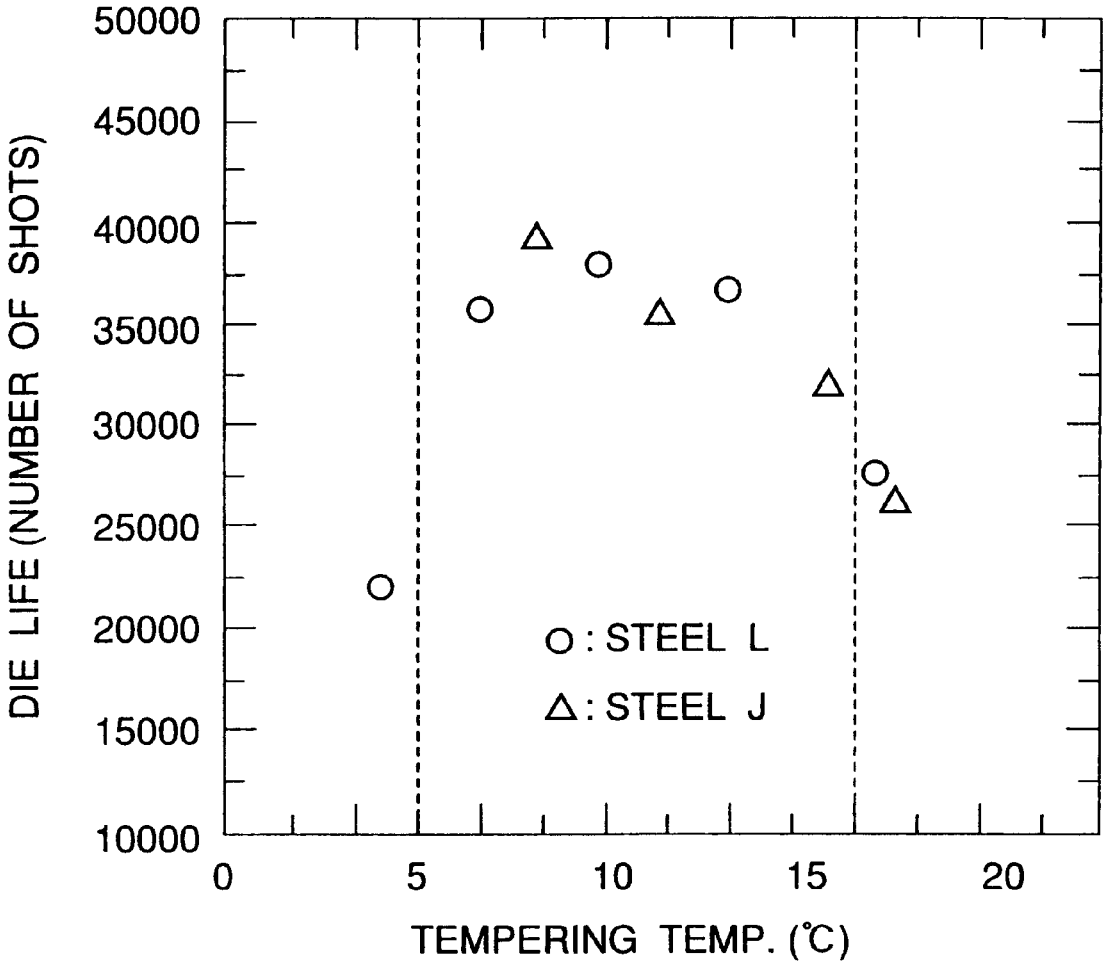
FIG. 4 is a diagram showing the relationship between the tempering temperature and the die life (number of shots) with respect to Example 2 of the present invention.

FIG. 4 is a diagram showing the relationship between the tempering temperature and the die life (number of shots). As shown in FIG. 4, regarding the die life (number of shots) for each tempering temperature, both steel J (Δ) and steel L (○) described below have substantially the same tendency, and the die life can be not less than 30000 at a tempering temperature of 150 to 500° C. By contrast, when the tempering temperature is above 500° C., the number of shots is not more than 30000, that is, the die life is deteriorated. For the above reason, when further prolongation of the die life is contemplated, the tempering temperature is brought to 150 to 500° C., preferably 150 to below 450° C.

EXAMPLE 1

600 kg of each of steels having respective chemical compositions specified in Table 1 was prepared in a vacuum induction melting furnace, cogged at a heating temperature of 1100° C. in a forging ratio of 15 s, gradually cooled to room temperature, and annealed at 860° C. to prepare materials under test. The machinability was evaluated by actually die-sinking dies in an annealed state each having a diameter of 120 mm and a length of 100 mm and comparing the time taken for the machining. As shown in Table 2, the test results were expressed by presuming the time, taken for the machining of steel H, to be 1. Test pieces and dies were held at 1040° C. for 30 min, air-cooled to conduct quenching, held at 520° C. for 60 min, and air-cooled twice. For the tensile compression fatigue test, a test piece having a size of 5 (diameter)×15 mm in a parallel section was prepared, and the tensile compression fatigue was measured under conditions of stress amplitude 1300 MPa, stress ratio R=−1, and room temperature using a hydraulic servo tester.

Carbides were specified by the following method. A part of one-fourth of a T-face was used as the measuring plane. The grain diameter was measured, in terms of an equivalent circular diameter, with an image processor, and the percentage area was measured with an image processor. Regarding the $M_7C_3$ carbide, all the carbides having a size of not less than 2 μm were regarded as the $M_7C_3$ carbide.

As is apparent from the results shown in Table 2, for all of steels A to G according to the present invention, the grain diameter of $M_7C_3$ carbides was 5 to 15 μm, the percentage area (%) of the $M_7C_3$ carbide was in the range of 1 to 9%, and the hardness (HRC) was not less than 59 HRC. Further, steels A to G according to the present invention were superior to conventional cold working tool steels H and I as the comparative steels in tensile compression fatigue life and prolongation of die life. In particular, for steels A, C, E, and G with sulfur added thereto according to the present invention, as compared with the convectional steels, the time taken for die sinking was shortened by 20 to 40%, that is, the machinability was significantly improved, and, at the same time, superior tensile compression fatigue life and prolongation of die life could be achieved.

TABLE 1

| Type of steel | Chemical composition (wt %) C | Si | Mn | S | Cr | Mo | Mo + W/2 | V | V + Nb/2 | Ex. |
|---|---|---|---|---|---|---|---|---|---|---|
| A | 0.67 | 0.71 | 0.98 | 0.096 | 5.8 | 2.0 | 2.0 | 1.6 | 1.6 | Steel |
| B | 0.74 | 0.84 | 0.87 | 0.001 | 6.3 | 1.5 | 3.3 | 0.7 | 0.7 | of |
| C | 0.80 | 0.88 | 0.41 | 0.048 | 8.2 | 1.9 | 1.9 | 0.5 | 0.5 | invention |
| D | 1.12 | 1.56 | 0.64 | 0.001 | 10.5 | 4.4 | 4.4 | 0.9 | 1.2 | |
| E | 1.29 | 0.64 | 0.75 | 0.064 | 9.8 | 1.3 | 1.8 | 1.4 | 2.3 | |
| F | 0.81 | 1.78 | 0.54 | 0.003 | 7.8 | 0 | 3.0 | 1.6 | 1.6 | |
| G | 0.89 | 0.90 | 0.38 | 0.038 | 9.1 | 0 | 4.5 | 0 | 0.9 | |
| H | 1.44 | 0.42 | 0.50 | — | 12.4 | 1.3 | 1.3 | 0.3 | 0.3 | Comp. |
| I | 0.63 | 0.39 | 0.51 | — | 5.4 | 1.0 | 2.2 | 0.5 | 0.5 | steel |

The Ohkoshi type wear test was carried out using SCM420 (86 HRB) as a counter material under conditions of wear distance 200 m and final load 62 N. As shown in Table 2, the test results were expressed by presuming the wear quantity of steel H to be 100. For a die test in an actual machine, forging dies having a size of diameter 120×100 mm were prepared, and the test was carried out using SCM 420 as a material to be worked. The die life expired due to wear or cracking. The interior of the dies, of which the service life expired due to cracking, was inspected. As a result, it was found that the cracking of carbides served as an origin of the fracture.

TABLE 2

| Type of steel | Grain diameter of $M_7C_3$ carbide (μm) | Percentage area of $M_7C_3$ carbide (%) | Hardness (HRC) | Ohkoshi type wear (index) | Tensile compression fatigue life (N) | Die life (number of shots) | Machinability | Ex. |
|---|---|---|---|---|---|---|---|---|
| A | 6.3 | 1.8 | 59.4 | 101 | 32560 | 25100 | 0.60 | Steel |
| B | 5.1 | 3.3 | 60.1 | 87 | 28470 | 22000 | 1 | of |
| C | 9.4 | 2.5 | 62.4 | 114 | 28470 | 26050 | 0.75 | invention |
| D | 14.9 | 8.4 | 62.8 | 104 | 27840 | 22500 | 0.98 | |
| E | 14.1 | 4.8 | 63.4 | 115 | 25620 | 18000 | 0.70 | |
| F | 10.4 | 3.7 | 62.7 | 98 | 26546 | 27010 | 0.90 | |
| G | 13.0 | 4.8 | 61.8 | 105 | 22400 | 28400 | 0.65 | |
| H | 20.1 | 10.1 | 61.1 | 100 | 16540 | 12500 | 1 | Comp. |
| I | 2.2 | 1.3 | 58.4 | 56 | 27870 | 15010 | 0.95 | steel |

EXAMPLE 2

Steels having respective chemical compositions specified in Table 3 were prepared in a vacuum induction melting furnace by a melt process. Steels J to M are steels of the present invention, while steels N and O are comparative steels. The steel ingots thus prepared were forged or hot rolled at 850 to 1200° C. to prepare materials under test. These materials under test were heated at 860° C., tempered at temperatures specified in Table 4, and subjected to a tensile compression fatigue test and an Ohkoshi type wear test.

TABLE 3

| Type of steel | Chemical composition (wt %) C | Si | Mn | Cr | Mo | Mo + W/2 | V | V + Nb/2 | Ex. |
|---|---|---|---|---|---|---|---|---|---|
| J | 0.69 | 0.70 | 0.98 | 5.7 | 0.6 | 2.0 | 1.0 | 1.6 | Steel |
| K | 0.92 | 0.84 | 0.87 | 9.3 | 0 | 1.5 | 2.2 | 2.2 | of |
| L | 0.80 | 1.21 | 0.41 | 8.2 | 2.6 | 2.6 | 0.5 | 0.5 | invention |
| M | 1.19 | 1.56 | 0.64 | 10.5 | 4.4 | 4.4 | 0 | 0.9 | |
| N | 0.62 | 0.39 | 0.51 | 4.8 | 1.1 | 2.2 | 0.5 | 0.5 | Comp. |
| O | 1.41 | 0.96 | 0.75 | 11.6 | 1.4 | 2.0 | 0.1 | 0.3 | steel |

For the tensile compression fatigue test, a test piece having a size of diameter 5×15 mm in a parallel section was prepared, and the tensile compression fatigue was measured under conditions of stress amplitude 1300 MPa, stress ratio R=−1, and room temperature using a hydraulic servo tester.

The Ohkoshi type wear test was carried out using SCM420 (86 HRB) as a counter material under conditions of wear distance 200 m and final load 62 N. The test results were expressed by presuming the wear quantity of steel O to be 100. For a die test in an actual machine, forging dies having a size of diameter 120×100 mm were prepared, and the test was carried out using SCM 420 as a material to be worked. The die life expired due to wear or cracking. The interior of the dies, of which the service life expired due to cracking, was inspected. As a result, it was found that the cracking of carbides served as an origin of the fracture.

TABLE 4

| Material under test | Type of steel | Grain diameter of $M_7C_3$ carbide (μm) | Percentage area of $M_7C_3$ carbide (%) | Tempering temp. (° C.) | Hardness (HRC) | Ohkoshi type wear (index) | Tensile compression fatigue life (N) | Die life (number of shots) | Ex. |
|---|---|---|---|---|---|---|---|---|---|
| 1 | J | 8.5 | 4.5 | 250 | 62.2 | 110 | 36000 | 38680 | Ex. of |
| 2 | J | 8.5 | 4.5 | 350 | 61.2 | 109 | 35900 | 36400 | invention |
| 3 | K | 5.6 | 2.7 | 200 | 61.7 | 106 | 38490 | 30200 | |
| 4 | K | 5.6 | 2.7 | 480 | 61.5 | 110 | 36920 | 31460 | |
| 5 | L | 10.1 | 8.3 | 200 | 61.1 | 118 | 34200 | 35640 | |
| 6 | L | 10.1 | 8.3 | 400 | 60.7 | 121 | 33800 | 36760 | |
| 7 | M | 14.1 | 6.4 | 170 | 62.0 | 120 | 30940 | 29980 | |
| 8 | M | 14.1 | 6.4 | 300 | 61.6 | 122 | 31270 | 30040 | |
| 9 | J | 8.5 | 4.5 | 520 | 62.7 | 109 | 29860 | 27490 | Comp. |
| 10 | L | 10.1 | 8.3 | 540 | 61.2 | 119 | 28980 | 26540 | Ex. |
| 11 | N | 6.8 | 4.7 | 180 | 58.2 | 58 | 21500 | 15400 | |
| 12 | O | 20.2 | 10.3 | 300 | 60.1 | 100 | 16560 | 12460 | |

Carbides were specified by the following method. A part of one-fourth of a T-face was used as the measuring plane. The grain diameter was measured, in terms of an equivalent circular diameter, with an image processor, and the percentage area was measured with an image processor. All the carbides having a size of not less than 2 μm were regarded as the $M_7C_3$ carbide.

As is apparent from the results shown in Table 4, material Nos. 1 to 8 have excellent tensile compression fatigue life and die life. For all of steels J to M for the material Nos. 1 to 8, the grain diameter of $M_7C_3$ carbides was 5 to 15 μm, the percentage area (%) of the $M_7C_3$ carbide was in the range of 1 to 9%, and the tempering temperature was 150 to 500° C. That is, these steels fall within the scope of the present invention. By contrast, for the material Nos. 9 and 10, the tensile compression fatigue life and the die life were lower than those of the material Nos. 1 to 8, because the tempering temperature was above the tempering temperature range specified in the present invention, although the chemical composition, the grain diameter of carbides, and the percentage area of the carbide fell within the scope of the present invention.

For all of the steels J to M according to the present invention, the hardness (HRC) was not less than 59 HRC, and, as compared with steels N and O as the conventional cold working tool steels, the tensile compression fatigue life and the prolongation of the die life were superior.

We claim:

1. A cold working tool steel having improved fatigue strength and die life, comprising by weight 0.65 to 0.89% of carbon, not more than 2.0% of silicon, 0.1 to 2.0% of manganese, 5.0 to 11.0% of chromium, 0.7 to 5.0%, in terms of molybdenum equivalent (molybdenum+tungsten/2), of at least one member selected from molybdenum and tungsten, and 0.1 to 2.5%, in terms of vanadium equivalent (vanadium+niobium/2), of at least one member selected from vanadium and niobium with the balance of iron and unavoidable impurities, an $M_7C_3$ carbide having a grain diameter of 5 to 15 μm being present in a percentage area of 1 to 9%.

2. The cold working tool steel according to claim 1, wherein said steel further contains 0.01 to 0.10% by weight of sulfur.

3. A cold working tool steel having improved fatigue strength and die life, comprising by weight 0.65 to 0.89% of carbon, not more than 2.0% of silicon, 0.1 to 2.0% of manganese, 5.0 to 11.0% of chromium, 0.7 to 5.0%, in terms of molybdenum equivalent (molybdenum+tungsten/2), of at least one member selected from molybdenum and tungsten, and 0.1 to 2.5%, in terms of vanadium equivalent (vanadium+niobium/2), of at least one member selected from vanadium and niobium with the balance consisting of iron and unavoidable impurities, an $M_7C_3$ carbide having a grain diameter of 5 to 15 μm being present in a percentage area of 1 to 9%, said cold working tool steel having been tempered at a temperature of 150 to 500° C.

4. The cold working tool steel according to claim 3, wherein said steel further contains 0.01 to 0.10% by weight of sulfur.

5. The cold working tool steel according to claim 3, or 4 wherein the tempering temperature is 150 to below 450° C.

6. A process for producing a cold working tool steel having improved fatigue strength and die life, characterized by comprising the steps of: providing a steel product comprising by weight 0.65 to 0.89% of carbon, not more than 2.0% of silicon, 0.1 to 2.0% of manganese, 5.0 to 11.0% of chromium, 0.7 to 5.0%, in terms of molybdenum equivalent (molybdenum+tungsten/2), of at least one member selected from molybdenum and tungsten, and 0.1 to 2.5%, in terms of vanadium equivalent (vanadium+niobium/2), of at least one member selected from vanadium and niobium with the balance consisting of iron and unavoidable impurities, an $M_7C_3$ carbide having a grain diameter of 5 to 15 μm being present in a percentage area of 1 to 9%; and tempering the steel product at a temperature of 150 to 500° C.

7. The process according to claim 6, wherein said steel further contains 0.01 to 0.10% by weight of sulfur.

8. The process according to claim 6 or 7, wherein the temperature for tempering the steel product is 150 to below 450° C.

9. The cold working tool steel according to claim 1 comprising by weight 0.67% of carbon, 0.71% of silicon, 0.98% of manganese, 5.8% of chromium, 2.0% of molybdenum+tungsten/2, and 1.6% of vanadium+niobium/2 with the balance consisting of iron and unavoidable impurities, an $M_7C_3$ carbide having a grain diameter of 5 to 15 μm being present in a percentage area of 1 to 9%.

10. The cold working tool steel according to claim 1, characterized by having a chemical composition comprising by weight 0.74% of carbon, 0.84% of silicon, 0.87% of manganese, 6.3% of chromium, 3.3% of molybdenum+tungsten/2, and 0.7% of vanadium+niobium/2 with the balance consisting of iron and unavoidable impurities.

11. The cold working tool steel according to claim 1, characterized by having a chemical composition comprising by weight 0.80% of carbon, 0.88% of silicon, 0.41% of manganese, 8.2% of chromium, 1.9% of molybdenum+tungsten/2, and 0.5% of vanadium+niobium/2 with the balance consisting of iron and unavoidable impurities.

12. The cold working tool steel according to claim 1, characterized by having a chemical composition comprising by weight 0.81% of carbon, 1.78% of silicon, 0.54% of manganese, 7.8% of chromium, 3.0% of molybdenum+tungsten/2, and 1.6% of vanadium+niobium/2 with the balance consisting of iron and unavoidable impurities.

13. The cold working tool steel according to claim 1, characterized by having a chemical composition comprising by weight 0.89% of carbon, 0.90% of silicon, 0.38% of manganese, 9.1% of chromium, 4.5% of molybdenum+tungsten/2, and 0.9% of vanadium+niobium/2 with the balance consisting of iron and unavoidable impurities.

14. The cold working tool steel according to claim 3 comprising by weight 0.69% of carbon, 0.70% of silicon, 0.98% of manganese, 5.7% of chromium, 2.0% of molybdenum+tungsten/2, and 1.6% of vanadium+niobium/2 with the balance consisting of iron and unavoidable impurities, an $M_7C_3$ carbide having a grain diameter of 5 to 15 μm being present in a percentage area of 1 to 9%, said cold working tool steel having been tempered at a temperature of 150 to 500° C.

15. The cold working tool steel according to claim 14, characterized by having a chemical composition comprising by weight 0.80% of carbon, 1.21% of silicon, 0.41% of manganese, 8.2% of chromium, 2.6% of molybdenum+tungsten/2, and 0.5% of vanadium+niobium/2 with the balance consisting of iron and unavoidable impurities.

* * * * *